US007334746B2

(12) United States Patent
Vich

(10) Patent No.: US 7,334,746 B2
(45) Date of Patent: Feb. 26, 2008

(54) SEAT-LOWER GUIDE COMBINATION

(75) Inventor: Gaetan Vich, Newport News, VA (US)

(73) Assignee: Continental Automotive Systems US, Inc., Auburn Hills ( * ) Notice: Subject to any disclaimer, the term of this patent is extended or adjusted under 35 U.S.C. 154(b) by 0 days.

(21) Appl. No.: 11/072,459

(22) Filed: Mar. 7, 2005

(65) Prior Publication Data

US 2005/0194470 A1 Sep. 8, 2005

Related U.S. Application Data

(60) Provisional application No. 60/551,304, filed on Mar. 8, 2004.

(51) Int. Cl.
*F02M 61/00* (2006.01)

(52) U.S. Cl. ..... 239/533.12; 239/533.11; 239/552; 239/585.1; 239/596; 239/900

(58) Field of Classification Search ..... 239/533.2, 239/533.11, 533.12, 533.14, 589, 593, 592, 239/596, 597, 598, 585.1, 900, 552, 600
See application file for complete search history.

(56) References Cited

U.S. PATENT DOCUMENTS

| | | | | |
|---|---|---|---|---|
| 4,482,129 | A * | 11/1984 | Baker et al. | 251/334 |
| 5,718,387 | A * | 2/1998 | Awarzamani et al. | 239/585.1 |
| 5,899,390 | A * | 5/1999 | Arndt et al. | 239/553 |
| 5,921,473 | A * | 7/1999 | Romann | 239/533.2 |
| 5,924,634 | A * | 7/1999 | Arndt et al. | 239/553 |
| 6,131,826 | A * | 10/2000 | Teiwes | 239/533.11 |
| 6,170,763 | B1 * | 1/2001 | Fuchs et al. | 239/533.12 |
| 6,173,914 | B1 | 1/2001 | Hopf et al. | 239/583 |
| 6,189,816 | B1 * | 2/2001 | Stier | 239/533.2 |
| 6,371,391 | B1 * | 4/2002 | Reiter | 239/585.1 |
| 6,454,188 | B1 * | 9/2002 | Maier | 239/533.12 |
| 6,736,104 | B2 * | 5/2004 | Maier et al. | 123/305 |
| 6,805,309 | B2 * | 10/2004 | Kobayashi et al. | 239/585.1 |
| 6,811,104 | B2 * | 11/2004 | Kobayashi et al. | 239/533.2 |
| 6,814,311 | B2 * | 11/2004 | Kobayashi et al. | 239/585.1 |
| 2002/0063175 | A1 * | 5/2002 | Kitamura et al. | 239/585.1 |

FOREIGN PATENT DOCUMENTS

| | | |
|---|---|---|
| EP | 0718490 | 6/1996 |
| WO | WO 2004/097209 | 11/2004 |

OTHER PUBLICATIONS

PCT International Search Report (PCT/US 2005/007470) Mailed May 11, 2005.

* cited by examiner

*Primary Examiner*—Steven J. Ganey

(57) ABSTRACT

A fuel injector for an internal combustion engine, including a housing, a homogeneous member defining a continuous wall having a seat portion and a guide portion, a closure member, and a metering disk. The housing includes an inlet and an outlet disposed along a longitudinal axis. The homogeneous member is disposed proximate the outlet. The seat portion includes a sealing surface and a seat orifice. The closure member is disposed in the housing and positioned by the guide portion for reciprocal motion along the longitudinal axis between a first position such that the closure member is displaced from the seat, allowing fuel flow past the closure member, and a second position such that the closure member is contiguous the seat, precluding fuel flow past the closure member. The metering disk is proximate the seat orifice.

8 Claims, 3 Drawing Sheets

SEAT-LOWER GUIDE COMBINATION

CROSS REFERENCE TO CO-PENDING APPLICATIONS

This application claims the benefit of the earlier filing date of U.S. Provisional Application No. 60/551,304, filed Mar. 8, 2004, which is incorporated by reference herein in the entirety.

FIELD OF THE INVENTION

The invention relates generally to a fuel injector for an internal combustion engine, and more particularly to a fuel injector in which atomization and precision targeting of fuel can be altered so as to meet particular requirements for different engine configurations.

BACKGROUND OF THE INVENTION

Most modern automotive fuel systems utilize fuel injectors to provide precise metering of fuel for introduction into each combustion chamber of an internal combustion engine. The fuel injectors atomize the fuel during injection, breaking the fuel into a large number of very small particles, increasing the surface area of the fuel being injected, and allowing an oxidizer, typically ambient air, to thoroughly mix with the fuel prior to combustion. The metering and atomization of the fuel reduces combustion emissions and increases the fuel efficiency of the engine. Thus, as a general rule, the greater the precision in metering and targeting of the fuel, and the greater the atomization of the fuel, the lower the emissions and the greater the fuel efficiency.

The fuel injector is typically mounted upstream of the intake valve in the intake manifold proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray pattern. Where the spray pattern has a large divergent cone shape, the sprayed fuel may impact on a surface of the intake port rather than towards its intended target. Conversely, where the spray pattern has a narrow divergent cone shape, the fuel may not atomize and may even recombine into a liquid stream. In either case, incomplete combustion may result, leading to an increase in undesirable exhaust emissions.

Complicating the requirements for targeting and spray pattern are cylinder head configuration and intake geometry specific to different engine designs. As a result, a fuel injector designed for a specified cone pattern and targeting of the fuel spray may work extremely well in one type of engine configuration but may present emissions problems upon installation in a different type of engine configuration.

An electromagnetic fuel injector typically utilizes a solenoid assembly to supply an actuating force to a fuel metering assembly. Typically, the fuel metering assembly is a plunger-style closure member which reciprocates between a closed position, where the closure member is positioned in a seat to prevent fuel from escaping through a metering orifice into the combustion chamber, and an open position, where the closure member is lifted from the seat, allowing fuel to discharge through the metering orifice for introduction into the combustion chamber. In reciprocating between the open and closed position, the closure member is positioned by a lower guide member that facilitates a proper contact with the seat. In known fuel injectors the lower guide member and the seat are two separate parts that need to be properly aligned during assembly of the fuel injector. A misalignment of the two parts may cause leakage of the fuel injector that will adversely affect precision metering and targeting of the fuel. To prevent such misalignment, the lower guide member and the seat have been formed as one homogeneous member. However, in known homogeneous lower guide and seat members, atomization and precision targeting of fuel can not be altered so as to meet particular requirements for different engine configurations.

It would be beneficial to develop a fuel injector having a lower guide member and a seat member in precise alignment, and in which atomization and precision targeting of fuel can be altered so as to meet particular requirements for different engine configurations.

SUMMARY OF THE INVENTION

A preferred embodiment provides a fuel injector for an internal combustion engine, including a housing, a homogeneous member defining a continuous wall having a seat portion and a guide portion, a closure member, and a metering disk. The housing includes an inlet and an outlet disposed along a longitudinal axis. The homogeneous member is disposed proximate the outlet. The seat portion includes a sealing surface and a seat orifice. The closure member is disposed in the housing and positioned by the guide portion for reciprocal motion along the longitudinal axis between a first position such that the closure member is displaced from the seat, allowing fuel flow past the closure member, and a second position such that the closure member is contiguous the seat, precluding fuel flow past the closure member. The metering disk is proximate the seat orifice.

Another preferred embodiment provides a method of manufacturing a fuel injector for an internal combustion engine. The fuel injector includes a housing having an inlet and an outlet disposed along a longitudinal axis, and a closure member disposed in the housing. The method includes providing a homogeneous member disposed proximate the outlet and defining a continuous wall having a seat portion and a guide portion. The seat portion includes a sealing surface and a seat orifice. The closure member is positioned by the guide portion and contiguous the seat portion. The method includes providing a metering disk proximate the seat orifice, the metering disk having a plurality of metering orifices configured to form a spray pattern particular to the internal combustion engine.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
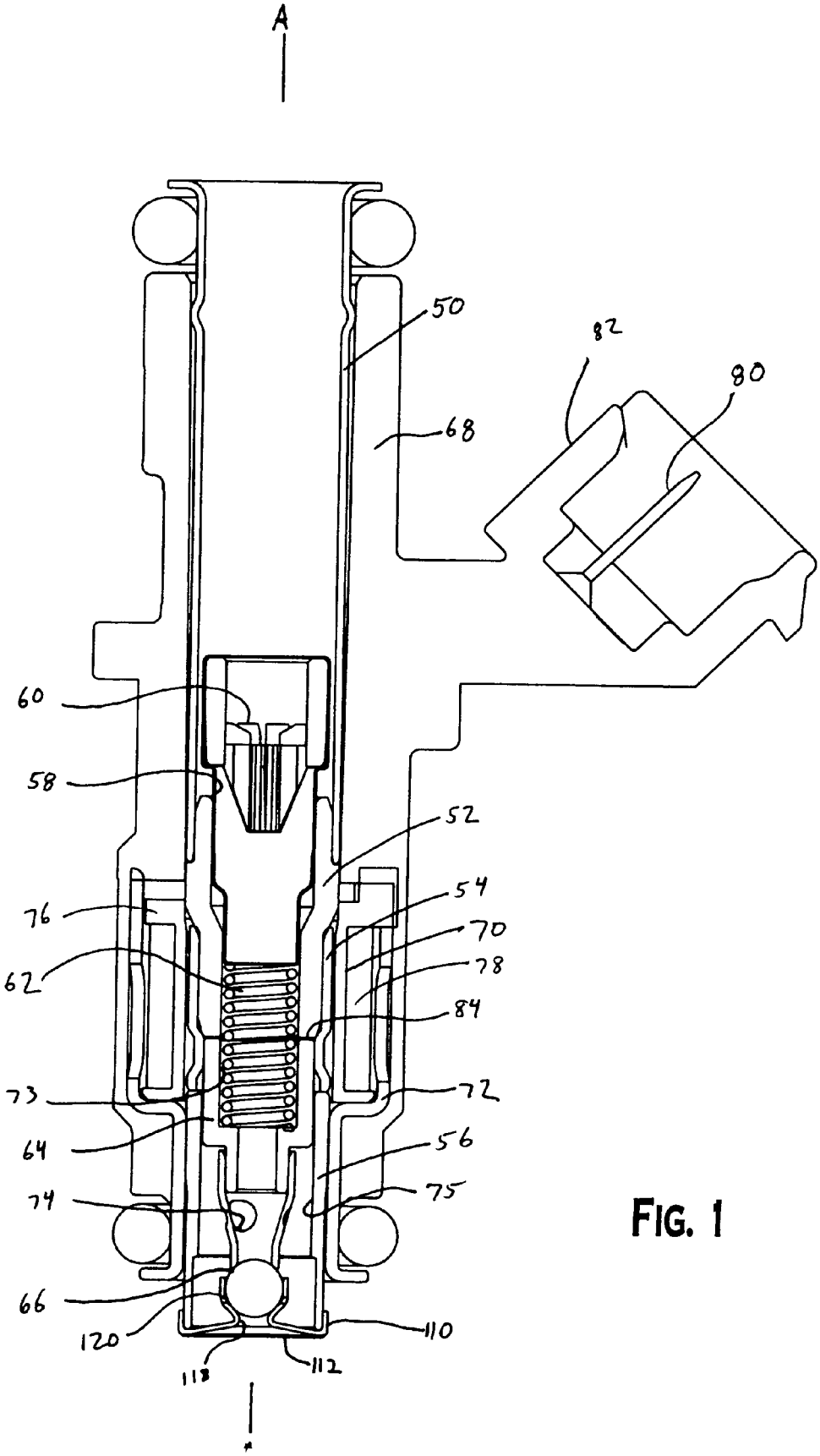
FIG. 1 is a cross-sectional view of a fuel injector including a seat-lower guide combination, according to an embodiment of the invention.
Figure 2:
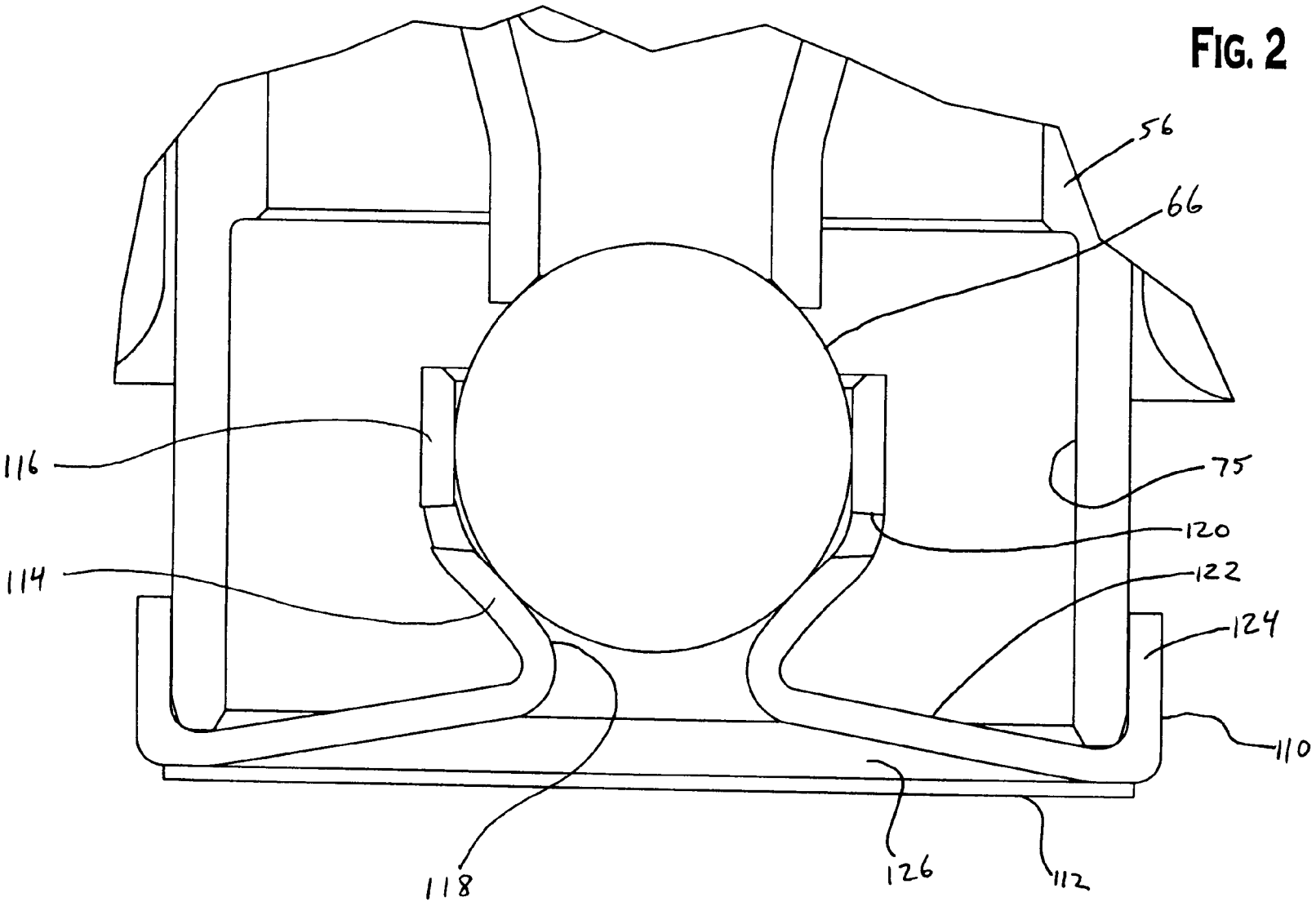
FIG. 2 is an enlarged view of the seat-lower guide combination of FIG. 1.

A preferred embodiment of a fuel injector having a seat-lower guide combination 110 is illustrated in FIG. 1. FIG. 2 is an enlarged view of the seat-lower guide combination 110 fixed to an outlet of the fuel injector. The fuel injector includes: a fuel inlet tube 50, a stator 52, a non-magnetic shell 54, a valve body 56, a metering disc 112, an adjustment tube 58, a filter assembly 60, a coil spring 62, an armature 64, a closure member 66, an overmold 68, a coil assembly 70 and a coil assembly housing 72.

Fuel inlet tube 50, stator 52, non-magnetic shell 54, and valve body 56 are joined preferably by hermetic laser welds to form a fluid-tight flow path between the fuel injector inlet and the fuel injector outlet. The seat-lower guide 110 is coupled at the outlet end of valve body 56 by a suitable coupling technique, such as, crimping, welding, bonding or riveting.

In the calibrated fuel injector, adjustment tube 58 has been positioned along longitudinal axis A-A within stator 52 to compress coil spring 62 to a desired bias force that urges the armature 64 and closure member 66 such that the rounded tip end of closure member 66 can be seated on a seat portion 114 of the seat-lower guide 110 to close an orifice 118. Filter assembly 60 can be fitted proximate an open upper end of adjustment tube 58 to filter particulate matter from fuel passing through the fuel injector.

After passing through adjustment tube 58, fuel enters a volume 73 that is cooperatively defined by adjustment tube 58, stator 52 and armature 64 and that contains coil spring 62. Armature 64 includes a passageway 74 that communicates volume 73 with a passageway 75 in valve body 56. Thus fuel may flow from volume 73, through passageways 74, 75, through passage holes 120 in the seat-lower guide 110, to the seat portion 114 of the deep drawn seat-lower guide 110.

Coil assembly 70 includes a plastic bobbin 76 on which an electromagnetic coil 78 is wound. Respective terminations of the coil 78 connect to respective terminals 80 that are shaped and, in cooperation with a surround 82 formed as an integral part of overmold 68, form an electrical connector for connecting the fuel injector to an electronic control circuit (not shown) that operates the fuel injector.

In operation, the fuel injector is initially at the non-injecting position shown in FIG. 1. In this position, a working gap 84 exists between the annular end face of stator 52 and the confronting annular end face of armature 64. Non-magnetic shell 54 assures that when electromagnetic coil 78 is energized, the magnetic flux will follow a path that includes armature 64. Starting at the lower axial end of housing 72, the magnetic circuit extends through valve body 56 to armature 64, and from armature 64 across the working gap 84 to stator 52, and back to housing 72. When electromagnetic coil 78 is energized, the spring force on armature 64 is overcome and armature 64 is attracted toward stator 52 reducing the working gap 84. This unseats closure member 66 from seat portion 114 to open the fuel injector so that pressurized fuel in the valve body 56 flows through passage holes 120 in the seat-lower guide 110, through orifice 118, into a chamber 126 and through the orifices 128 patterned on a metering disc 112. When the coil 78 ceases to be energized, coil spring 62 pushes the armature/closure member closed on seat portion 114.

Figure 3:
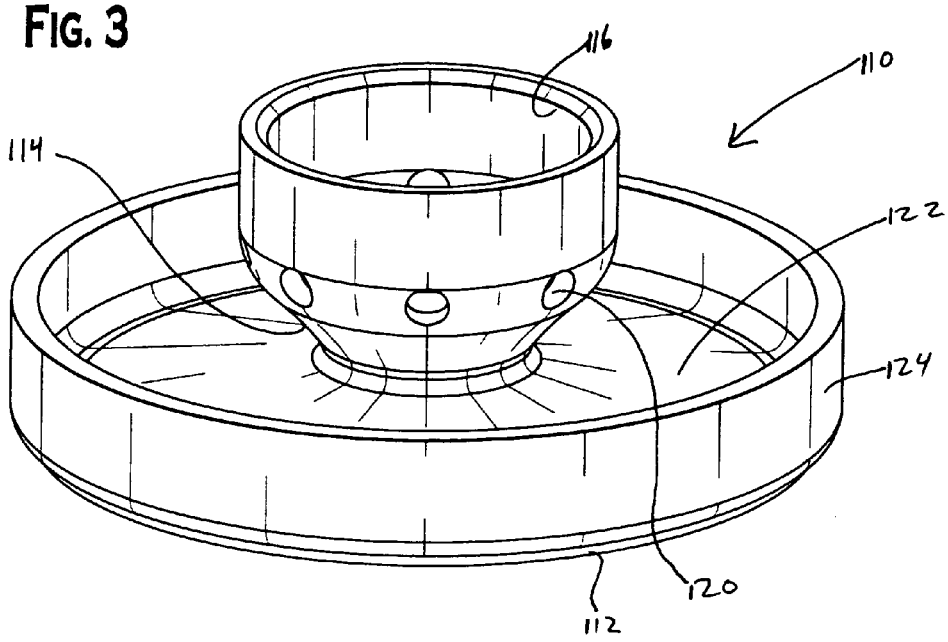
FIG. 3 is a perspective view of the seat-lower guide combination, according to an embodiment of the invention.
Figure 4:
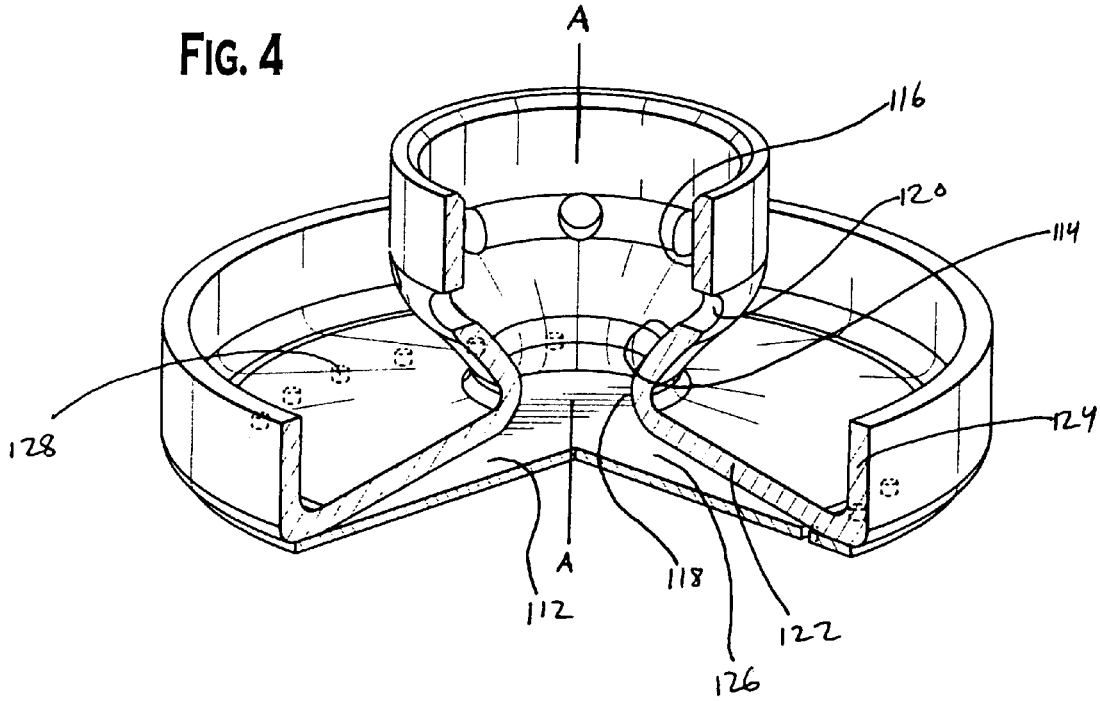
FIG. 4 is cut-away view of the seat-lower guide combination of FIG. 3.

FIG. 3 illustrates a preferred embodiment of the seat-lower guide combination 110. FIG. 4 is a cut-away view of the seat-lower guide combination 110. In the preferred embodiment, seat-lower guide combination 110 is a homogeneous member formed as a continuous wall. Preferably the continuous wall is formed of metal by a deep drawn manufacturing process. However, the continuous wall may be formed of other materials and by other processes so long as a seat portion 114 and a guide portion 116 of the seat-lower guide combination 110 are properly aligned with respect to each other. Guide portion 116 defines a cylinder disposed along the longitudinal axis A-A. Seat portion 114 generally defines a conic frustum disposed along the longitudinal axis A-A, and having its base integrally formed with one end of guide portion 116, and its apex forming an orifice 118. Passage holes 120 radially spaced about longitudinal axis A-A by equal intervals penetrate the seat-lower guide combination at a wall portion intermediate the guide portion and seat portion. As illustrated in FIG. 2, guide portion 116 properly positions the closure member 66 on seat portion 114 to form a fluid-tight seal between closure member 66 and seat portion 114. Guide portion 116 and seat portion 114 being formed as a homogeneous member precludes misalignment between these portions that could occur if the portions were separate parts that needed to be aligned with respect to each other during assembly of the fuel injector.

In the preferred embodiment, the continuous wall of seat-lower guide combination 110 may further include a metering disk support portion 122 and a retaining portion 124, both being formed integrally with the guide portion and the seat portion. Retaining portion 124 forms a fluid tight connection with an outer surface of valve body 56 proximate the outlet of the fuel injector, as illustrated in FIG. 2. Portion 122 defines an annulus extending between the apex of seat portion 114 and the retaining portion 124, and supports the metering disk 112. As shown in FIG. 2 and FIG. 4, portion 122 extends radially outward at an oblique angle from longitudinal axis A-A and forms a chamber 126 with metering disk 112. Metering disk 112 includes a plurality of orifices 128 to allow fuel to be discharged from the fuel injector. Different metering disks 112 having different size, shape, number and pattern of orifices 128 may be fixed to metering disk support portion 122 so that atomization and precision targeting of fuel can be altered to meet particular requirements for different engine configurations. For example, the seat-lower guide 110 can be used with the fuel injector/metering disk arrangements disclosed in co-pending application Ser No. 10/183,406 filed Jun. 28, 2002; Ser No. 10/183,392 filed Jun. 28, 2002; Ser No. 10/753,378 filed Jan. 9, 2004; Ser No. 10/753,481 filed Jan. 9, 2004; and Ser No. 10/753,377 filed Jan. 9, 2004, which are incorporated by reference herein in the entirety.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel injector for an internal combustion engine, comprising:

a housing having an inlet and an outlet disposed along a longitudinal axis;

a homogeneous member disposed proximate the outlet and defining a continuous wall having a seat portion and a guide portion, the seat portion including a sealing surface and a seat orifice, the homogeneous member further comprising a passage penetrating the continuous wall intermediate the guide portion and the seat portion;

a closure member in the housing positioned by the guide portion for reciprocal motion along the longitudinal axis between a first position wherein the closure member is displaced from the seat, allowing fuel flow past the closure member, and a second position wherein the closure member is contiguous the seat, precluding fuel flow past the closure member; and a metering disk proximate the seat orifice;

wherein the continuous wall includes a support portion integrally formed with the seat portion, the metering disk being fixed to the support portion; and wherein the continuous wall includes a retaining portion integrally formed with the support portion, the retaining portion being fixed at the housing outlet.

2. The fuel injector of claim 1, wherein:

the guide portion defines a cylinder disposed along the longitudinal axis; and the seat portion generally defines a conic frustum disposed along the longitudinal axis, the conic frustum having a base and an apex, the base being integrally formed with one end of the cylinder, and the apex forming the seat orifice.

3. The fuel injector of claim 2, wherein the passage comprises a plurality of passage holes radially spaced about the longitudinal axis and formed in the continuous wall.

4. The fuel injector of claim 1, the homogeneous member comprising metal formed by a deep-drawn manufacturing process.

5. A fuel injector for an internal combustion engine, comprising:

a housing having an inlet and an outlet disposed along a longitudinal axis a homogeneous member disposed proximate the outlet and defining a continuous wall having a seat portion and a guide portion, the seat portion including a sealing surface and a seat orifice, the homogeneous member further comprising a passage penetrating the continuous wall intermediate the guide portion and the seat portion;

a closure member in the housing positioned by the guide portion for reciprocal motion along the longitudinal axis between a first position wherein the closure member is displaced from the seat, allowing fuel flow past the closure member, and a second position wherein the closure member is contiguous the seat, precluding fuel flow past the closure member; and a metering disk proximate the seat orifice;

wherein the continuous wall includes a support portion integrally formed with the seat portion, the metering disk being fixed to the support portion; and wherein the support portion defines an annulus extending radially between the apex of the seat portion and the retaining portion, at an oblique angle from the longitudinal axis.

6. The fuel injector of claim 5, wherein the support portion and the metering disk define a chamber.

7. The fuel injector of claim 5, wherein the metering disk includes a plurality of metering orifices configured to form a spray pattern particular to the internal combustion engine.

8. A fuel injector for an internal combustion engine, comprising:

a housing having an inlet and an outlet disposed along a longitudinal axis;

a homogeneous member disposed proximate the outlet and defining a continuous wall that is formed of metal by a deep-drawn manufacturing process, the continuous wall including:

a guide portion defining a cylinder disposed along the longitudinal axis;

a seat portion having a sealing surface and a seat orifice, the seat portion defining a conic frustum disposed along the longitudinal axis, the conic frustum having a base and an apex, the base being integrally formed with one end of the cylinder, and the apex forming the seat orifice;

a retaining portion that fixes the homogeneous member to the housing outlet;

a support portion that attaches a metering disk thereto, the support portion defining an annulus extending radially between the apex of the seat portion and the retaining portion, at an oblique angle from the longitudinal axis; and a plurality of passage holes radially spaced about the longitudinal axis and formed in the continuous wall intermediate the guide portion and the seat portion;

a closure member in the housing positioned by the guide portion for reciprocal motion along the longitudinal axis between a first position wherein the closure member is displaced from the seat, allowing fuel flow past the closure member, and a second position wherein the closure member is contiguous the seat, precluding fuel flow past the closure member; and a metering disk fixed to the support portion proximate the seat orifice, the metering disk having a plurality of metering orifices configured to form a spray pattern particular to the internal combustion engine.

* * * * *